US010826238B2

(12) United States Patent
Ochiai et al.

(10) Patent No.: US 10,826,238 B2
(45) **Date of Patent: *Nov. 3, 2020**

(54) CONNECTOR AND CONNECTOR ASSEMBLY

(71) Applicant: Sumitomo Wiring Systems, Ltd., Mie (JP)

(72) Inventors: Wataru Ochiai, Mie (JP); Ryotaro Kosaka, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/175,972

(22) Filed: Oct. 31, 2018

(65) Prior Publication Data

US 2019/0148879 A1 May 16, 2019

(30) Foreign Application Priority Data

Nov. 14, 2017 (JP) ..... 2017-219250

(51) Int. Cl.

| | |
|---|---|
| ***H01R 13/629*** | (2006.01) |
| ***H01R 13/453*** | (2006.01) |
| ***H01R 13/436*** | (2006.01) |
| *H01R 13/04* | (2006.01) |

(52) U.S. Cl.

CPC ... *H01R 13/62927* (2013.01); *H01R 13/4364* (2013.01); *H01R 13/4538* (2013.01); *H01R 13/62938* (2013.01); *H01R 13/04* (2013.01); *H01R 13/4365* (2013.01); *H01R 13/62977* (2013.01)

(58) Field of Classification Search

CPC ..... H01R 13/62927; H01R 13/4364; H01R 13/62938; H01R 13/62933; H01R 13/62977; H01R 13/629; H01R 13/62

USPC ..... 439/372, 157, 146, 147

See application file for complete search history.

(56) References Cited

U.S. PATENT DOCUMENTS

| | | | | |
|---|---|---|---|---|
| 6,095,833 A * | 8/2000 | Osawa | ..... | H01R 13/62933 439/157 |
| 6,692,274 B2 * | 2/2004 | Maegawa | ..... | H01R 13/62933 439/157 |
| 7,329,133 B2 * | 2/2008 | Ishikawa | ..... | H01R 13/62938 439/140 |
| 8,147,261 B2 * | 4/2012 | Horiuchi | ..... | H01R 13/514 439/157 |
| 2001/0039144 A1 * | 11/2001 | Osawa | ..... | H01R 13/5202 439/589 |

(Continued)

FOREIGN PATENT DOCUMENTS

| | | |
|---|---|---|
| JP | 2011-14454 | 1/2011 |

*Primary Examiner* — Travis S Chambers

(74) *Attorney, Agent, or Firm* — Gerald E. Hespos; Michael J. Porco; Matthew T. Hespos

(57) ABSTRACT

A connector assembly includes a female housing (11) and a male housing (12) connectable to each other. Male terminal fittings (39) have tabs (41) projecting into a receptacle (36) of the male housing (12), and a moving plate (15) to be movably accommodated into the receptacle (36). The moving plate (15) includes a plate body (94) with positioning holes (96) enabling the insertion of the tabs (41) and a peripheral wall (95) connected to a periphery of the plate body (94) and slidable on an inner surface of the receptacle (36). An operating portion (103) for removal is provided on the peripheral wall (95) and is exposed from the receptacle (36).

9 Claims, 20 Drawing Sheets

(56) References Cited

U.S. PATENT DOCUMENTS

2010/0159734 A1* 6/2010 Horiuchi ..... H01R 13/514
439/374
2019/0148882 A1* 5/2019 Kosaka ..... H01R 13/62955
439/372

* cited by examiner

CONNECTOR AND CONNECTOR ASSEMBLY

BACKGROUND

Field of the Invention

The invention relates to a connector and to a connector assembly.

Related Art

Japanese Unexamined Patent Publication No. 2011-14454 discloses a connector assembly with a female housing and a male housing that are connectable to each other. A lever is assembled rotatably with the male housing, and a moving plate is accommodated into a receptacle of the male housing. Tabs of male terminal fittings project into the receptacle.

The moving plate includes a plate body and a rectangular tubular peripheral wall projects forward from a periphery of the plate body. Positioning holes penetrate through the plate body and can receive the tabs.

The moving plate is movable to an initial position where the plate body is on an opening end of the receptacle and a connection position that is reached as the housings are connected and where the plate body is at a back side of the receptacle. Tips of the tabs of the male terminal fittings are inserted through the positioning holes at the initial position and are protected.

At the time of maintenance or the like, the moving plate needs to be removed. However, the moving plate is accommodated in the receptacle at the initial position and the entire peripheral plate portion is covered by the receptacle. Thus, it is difficult to grab the moving plate by worker's fingers and the moving plate normally needs to be pulled out from the receptacle using a tool, which causes poor workability.

The invention was completed on the basis of the above situation and aims to enable a moving plate to be removed easily.

SUMMARY

Another aspect of the invention relates to a connector comprising a housing including a receptacle into which a mating housing fits. Terminal fittings with tabs project into the receptacle and a moving plate is accommodated movably in the receptacle. The moving plate includes a plate body with positioning holes enabling insertion of the terminal fittings. At least one peripheral wall is connected to a peripheral edge of the plate body and can slide on an inner surface of the receptacle. An operating portion for removal is provided on the peripheral wall and is at least partly exposed from the receptacle. Accordingly, the moving plate can be removed easily by a worker placing fingers on the operating portion and operating the operating portion.

The receptacle may include a recess, particularly in the form of a cutout, to receive the operating portion.

The receptacle may include at least one rib extending substantially along a periphery of the recess.

The operating portion may include an outer flat surface at least partly exposed on an outer surface of the peripheral wall and an inner flat surface at least partly exposed on an inner surface of the peripheral wall.

A recess may be provided in an outer surface of the peripheral wall and may include at least one step extending in a direction intersecting a moving direction of the moving plate. The step may be included in the operating portion.

An outer flat surface may be on the outer surface of the peripheral wall and may be connected to the step so as to be continuous with the surrounding. The operating portion may include the step and the outer flat surface portion.

A projection may be provided at a position substantially opposite to the recess on the inner surface of the receptacle and may be shaped to correspond to the recess.

The connector assembly also may include a lever configured to connect the housing with the mating housing. The lever may be assembled rotatably with the housing. The lever is configured to assume an assembling posture in which the lever is to be assembled with the housing and a connection starting posture that is attained by rotating the lever from the assembling posture and in which the connection of the housing with the mating housing can be started. The lever includes one or more plates. The plate includes a cam groove, and one or more cam pins are provided on the peripheral wall of the moving plate. The cam pins are configured to move the moving plate by being engaged with the cam grooves. A lock is provided on a surface of the cam groove and is configured to retain the moving plate by locking the cam pin in the connection starting posture of the lever. The cam pin is separated from the lock and is at an entrance of the cam groove to be able to come out in the assembling posture of the lever.

Another aspect of the invention relates to the above-described connector assembly and a mating connector having a mating housing connectable to the housing. A lever is assembled rotatably with the housing and is configured to connect the housings. The mating housing includes a lever lock configured to lock the lever, and the lever lock at least partly enters the recess.

An escaping portion may be provided in a base part of the lever lock and may be configured to allow the operating portion to escape.

The invention relates to a connector assembly that includes first and second housings. The second housing includes a receptacle and the first housing can fit in the receptacle. A lever is assembled with the second housing and is configured to connect the housings by being displaced. A lever lock projects from the first housing. The receptacle has a recess in the form of a cutout, and the lever lock enters the recess. The lever includes at least one lever lock receiving portion that is to be locked by the lever lock that has entered the recess. The lever lock enters the recess, and therefore, a length of the connector assembly in the fitting direction can be made smaller.

The first housing may have a connection surface facing forward along a fitting direction into the receptacle. A wire pull-out surface faces substantially rearward along the fitting direction toward a side substantially opposite to the facing side of the connection surface. At least one wire is pulled out from the wire pull-out surface. The first housing also may have a side surface substantially facing in a direction intersecting each of the wire pull-out surface and the connection surface, and the lever lock portion may be provided on the side surface of the first housing.

In one embodiment, no part of the lever lock projects rearward along the fitting direction from the wire pull-out surface.

A mutually locking structure of the lever lock and the lever lock receiving portion may be visually confirmable from the outside of the side surface of the first housing.

In one embodiment, the entire lever lock enters the recess of the receptacle.

The receptacle may have at least one rib substantially extending along an edge of the recess.

The lever lock that has entered the recess may project higher than an outer surface of the receptacle located around the lever lock.

The receptacle may include first and second side walls substantially facing each other across a fitting space into which the first housing is fit. The recess may be in first side wall, and the second side wall may have a mounting portion for mounting on a vehicle body.

The receptacle may include at least one excessive rotation restricting portion capable of contacting the lever when the lever lock and the lever lock receiving portion are locked to each other. Two of the excessive rotation restricting portions may be provided and may be disposed on both sides across the recess on the receptacle.

At least one prying preventing portion may be provided on an outer surface of the first housing to prevent prying connection of the housings. Additionally, at least one prying prevention receiving portion may bulge out on the receptacle and may receive the prying prevention portion. The excessive rotation restricting portion may be provided on a bulging end surface of the prying prevention receiving portion.

Second terminal fittings having tabs may project in the receptacle and a moving plate may be accommodated movably in the receptacle. The moving plate may include a plate body with positioning holes to receive the tabs. A peripheral wall may be connected to the plate body and may be slidable on an inner surface of the receptacle. An operating portion for removal may be provided on the peripheral wall and may enter the recess. An escaping portion may be provided in a base end part of the lever lock, and may be configured to allow the operating portion to escape.

Another aspect of the invention relates to a connector, comprising a housing connectable to a mating housing of a mating connector. The housing includes at least one side surface. At least one shaft projects on the side surface and a wall is arranged outside the side surface. The connector further includes a lever with a lever operating portion for a rotating operation. At least one plate projects from the lever operating portion and has at least one cam groove to be engaged with a cam follower on the mating housing. At least one bearing and at least one wall engaging portion are provided on the plate. The wall engaging portion can enter a space adjacent to the wall in a rotating direction by having the plate face the side surface and having the shaft fit into the bearing and contact the wall from the outside with the plate deflected by erroneously facing the side surface not corresponding thereto.

The lever may be configured to assume: an assembling posture in which the lever is to be assembled with the housing; a connection starting posture attained by being rotated from the assembling posture and in which the cam follower enters the cam groove; and a connection ending posture attained by being rotated from the connection starting posture and in which the cam follower is at or near a back of the cam groove. The wall engaging portion faces an entrance opening inside the wall in the assembling posture.

The wall engaging portion may be in the space from the connection starting posture to the connection ending posture.

The wall may be asymmetrical with respect to a virtual axis passing through the shaft and extending along a fitting direction of the housing to the mating housing.

The wall may include a short part extending a short distance from the virtual axis toward one side perpendicular to the fitting direction and a long part extending a longer distance than the short part from the virtual axis toward the other side perpendicular to the fitting direction. The entrance for the wall engaging portion may be inside or on the short part.

The shaft may include, on each of the side surfaces, a shaft body projecting from the side surface and two projecting pieces projecting toward substantially opposite radial sides from the shaft body. The bearing includes, in each of the plates, a shaft hole configured so that the shaft body penetrates therethrough and two escaping holes communicating with the shaft hole, extending toward opposite radial sides and configured to allow passage of the projecting pieces therethrough. Each of the plates may include a sliding surface around or near an opening of the shaft hole. The projecting pieces are slidable on the sliding surface in the rotating direction.

The projecting pieces and the escaping holes may extend substantially along the fitting direction.

The wall engaging portions may be ribs provided on an outer periphery of the respective plates and substantially extending in the rotating direction. A length of the wall engaging portion in the rotating direction may be equal to or longer than a length of the wall in the rotating direction.

The lever may assume: a connection starting posture in which the cam follower enters the cam groove; and a connection ending posture attained by being rotated from the connection starting posture and in which the cam follower is on a back side of the cam groove. The wall engaging portion may be one or more ribs provided on an outer periphery of the respective plate and extending in the rotating direction. The wall engaging portion may be exposed partially from the wall to be visually confirmable in the connection ending posture.

The wall engaging portion may be configured to enter the space inside the wall and slide on an inner surface of the wall.

A further aspect of the invention relates to a connector assembly, comprising the above-described connector with a housing and a mating connector having mating housing including at least one cam follower. The mating housing is connectable to the housing.

In accordance with the invention, the wall engaging portions enter the spaces and contact the walls from inside. Thus, the plates cannot move radially out or expand. Further, when the lever is in an erroneous assembling posture, the wall engaging portions contact with the walls from outside to deflect the plates. Therefore, the shafts cannot be fit into the bearings and the lever cannot be mounted on the housing in the erroneous posture.

These and other features of the invention will become more apparent upon reading the following detailed description and accompanying drawings. Even though embodiments are described separately, single features may be combined to additional embodiments.

DETAILED DESCRIPTION

Figure 1:
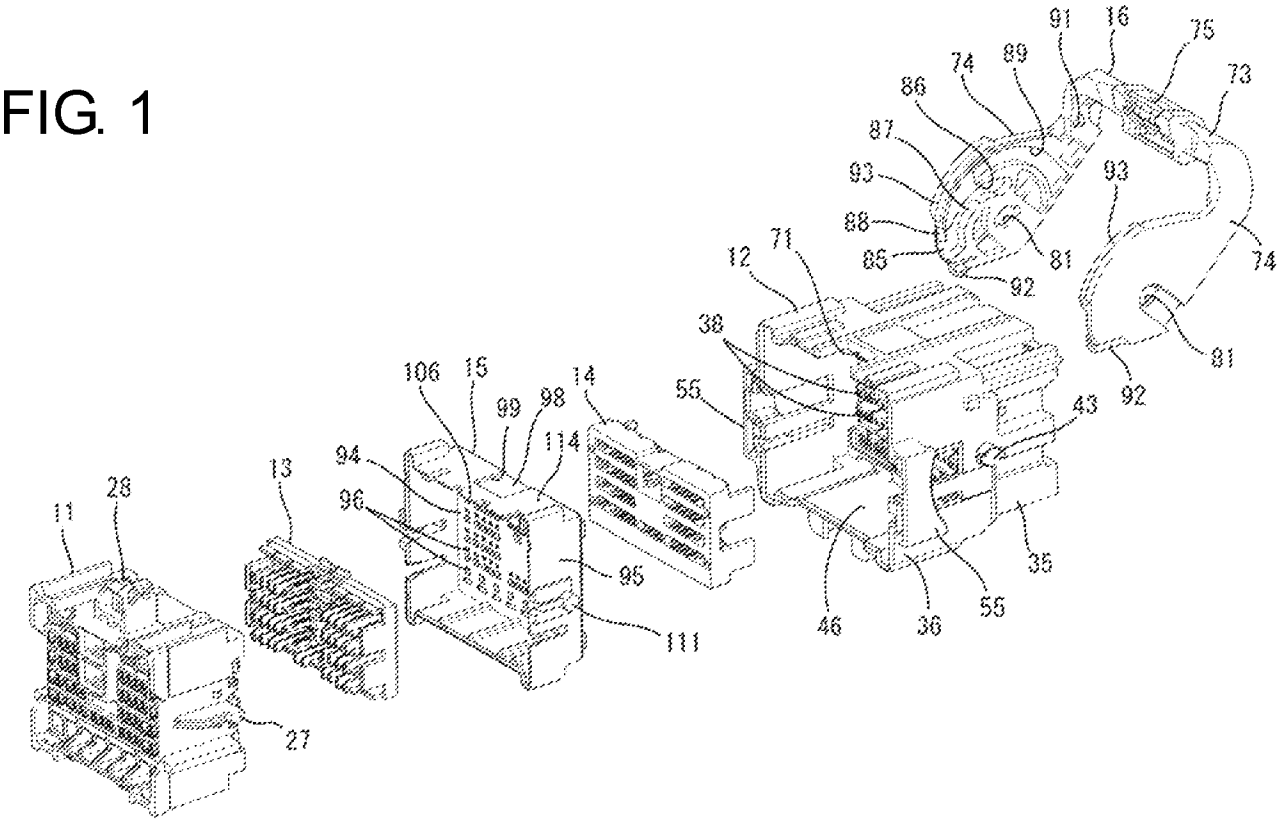
FIG. 1 is an exploded perspective view of a connector assembly in one embodiment of the present invention.

One embodiment is described on the basis of the drawings. A connector of this embodiment includes, as shown in FIG. 1, a female housing 11 and a male housing 12 connectable to each other, a female front retainer 13 to be mounted into the female housing 11, a male front retainer 14 to be mounted into the male housing 12, a moving plate 15 to be mounted into the male housing 12 and a lever 16 to be mounted on the male housing 12. In the following description, surfaces facing each other when the connection of the female and male housings 11, 12 is started are referred to as fronts concerning a front-rear direction, and a vertical direction is based on figures except FIGS. 7, 10, 12, 14 and 17.

Figure 16:
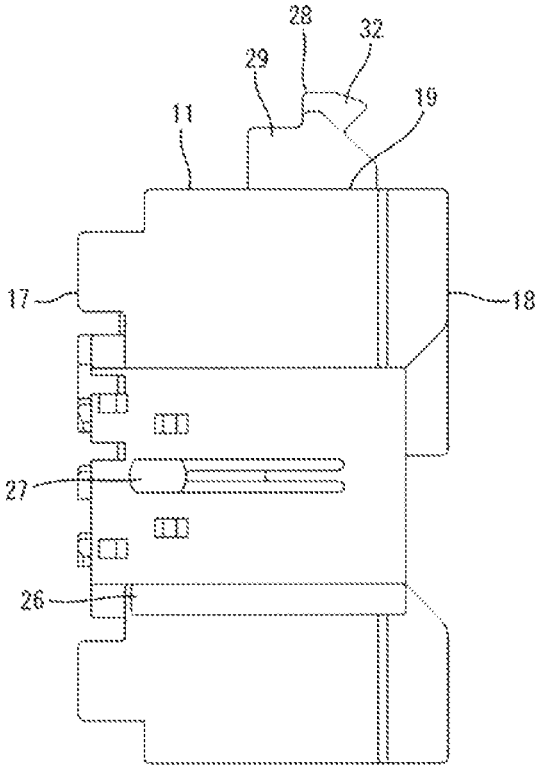
FIG. 16 is a side view of the female housing.

The female housing 11 is made of synthetic resin and in the form of a rectangular block. As shown in FIG. 16, the female housing 11 has a connection surface 17 on a front, a wire pull-out surface 18 on a rear and a side surface 19 facing in directions perpendicular to (intersecting) the wire pull-out surface 18 and the connection surface 17 on a periphery. The side surface 19 is composed of upper and lower walls and left and right walls.

Figure 8:
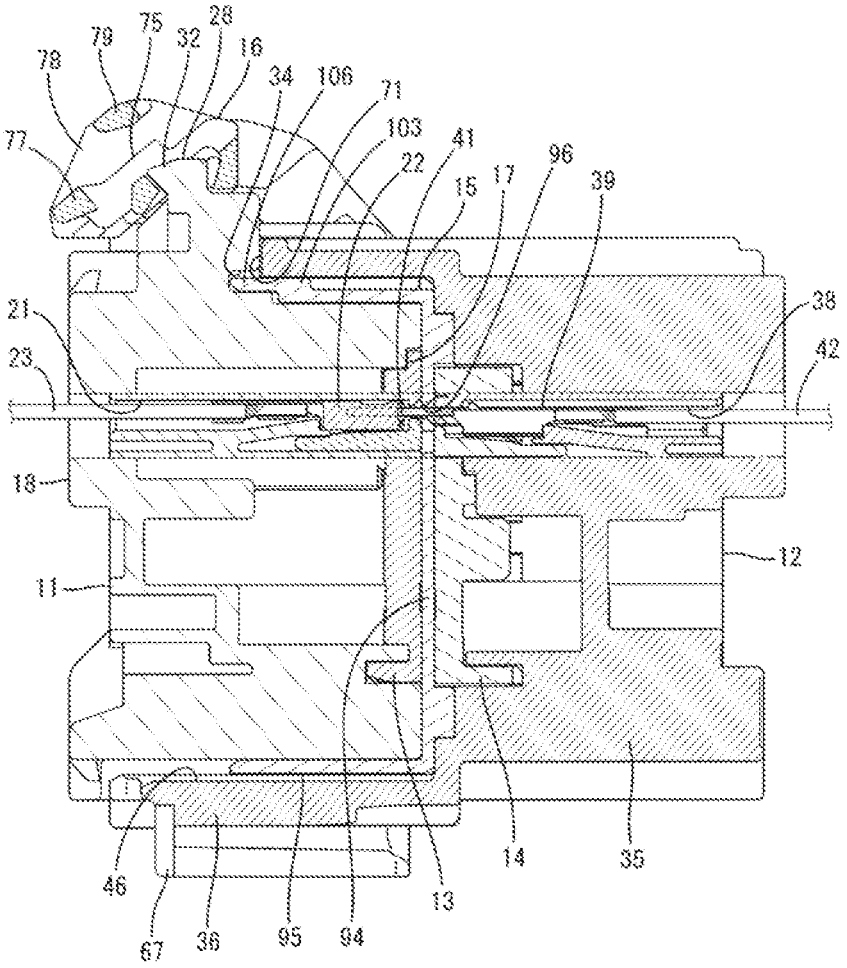
FIG. 8 is a section of the connector assembly in the connected state.
Figure 15:
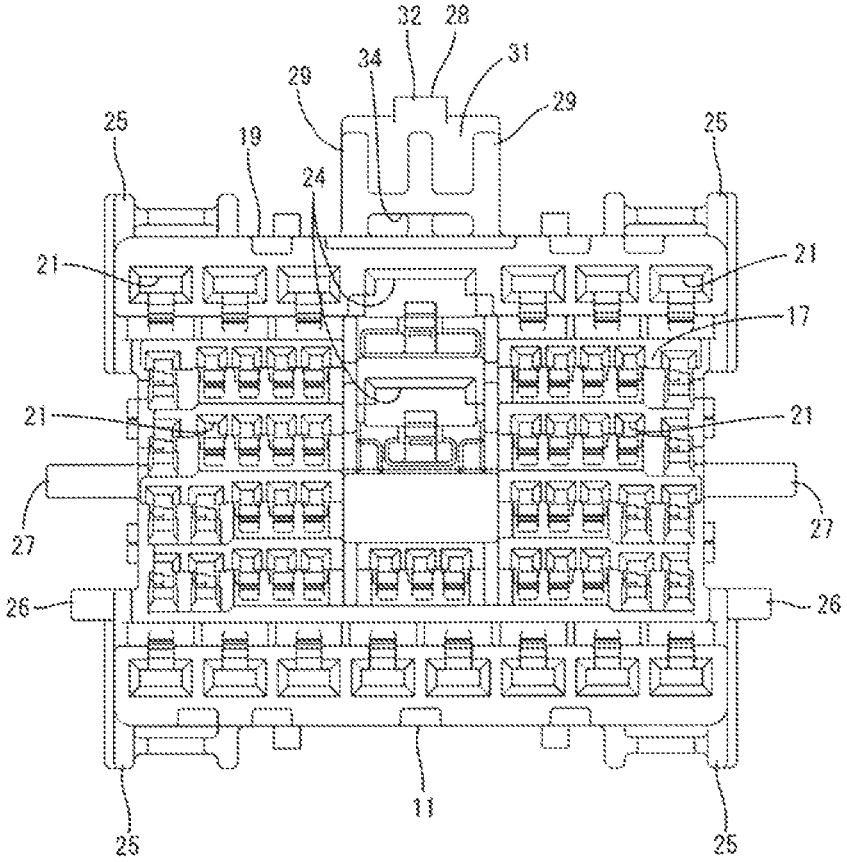
FIG. 15 is a front view of the female housing.

As shown in FIG. 15, female cavities 21 penetrate the female housing 11 in the front-rear direction. As shown in FIG. 8, a female terminal fitting 22 is inserted and accommodated into each female cavity 21 from behind. Each female terminal fitting 22 is made of conductive metal and connected to an end part of a wire 23. Each wire 23 is pulled out rearward from the wire pull-out surface 18.

As shown in FIG. 15, the housing 11 also includes large-diameter cavities 24 having a larger diameter than the surrounding female cavities 21 are provided in an upper part of a laterally central part of the female housing 11. The large-diameter cavities 24 are arranged one above the other in the vertical direction and have large female terminal fitting 22 respectively inserted therein.

As shown in FIG. 15, the female housing 11 includes prying preventing portions 25 on both left and right end sides of the upper and lower surfaces and releasing portions 26 on lower sides of the left and right surfaces. The prying preventing portions 25 and the releasing portions 26 are in the form of plates extending in the front-rear direction. Two cam followers 27 project on vertically central sides of the left and right surfaces of the female housing 11. Each cam follower 27 has a cross-sectional shape flat in the front-rear direction.

Figure 14:
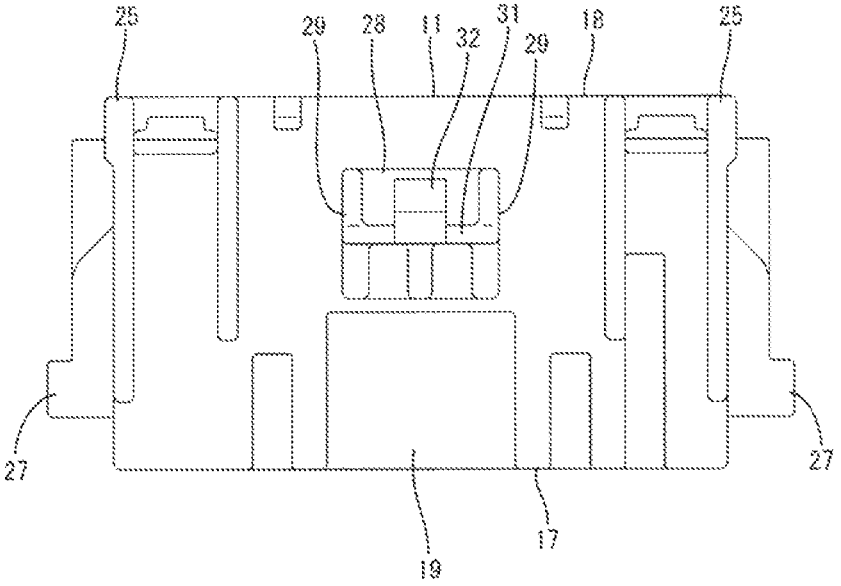
FIG. 14 is a plan view of the female housing.

As shown in FIGS. 14 and 15, the female housing 11 includes a lever lock 28 on a rear part of a laterally central side of the upper surface. The lever lock 28 includes two side walls 29 rising up from the upper surface of the female housing 11 and a coupling wall 31 linking the side walls 29. The coupling wall 31 includes a claw-like lever lock projection 32 projecting rearward on an upper part of a rear surface. As shown in FIG. 16, the lever lock projection 32 projects slightly higher than the surrounding. As shown in FIG. 14, the lever lock 28 is arranged above the large-diameter cavities 24 to be entirely accommodated within a range of the upper surface of the female housing 11 in a plan view. Thus, the lever lock 28 includes no part projecting farther rearward than the wire pull-out surface 18 of the female housing 11 and can avoid contact with the respective wires 23 pulled out from the wire pull-out surface 18.

As shown in FIG. 15, the lever lock 28 includes an escaping portion 34 which is a base part facing the upper surface of the female housing 11 and open forward between the side walls 29 and the coupling wall 31. The escaping portion 34 is open in the form of a slit flat in a width direction and penetrates in the front-rear direction except at a laterally central part on a rear side.

The female front retainer 13 is made of synthetic resin and, as shown in FIG. 8, mounted into the female housing 11 from front to cover the connection surface 17 of the female housing 11. Each female terminal fitting 22 is retained and held in each female cavity 21 by the female front retainer 13.

The male housing 12 is made of synthetic resin and, as shown in FIGS. 1, 8, 12 and 13, is composed of a terminal accommodating portion 35 in the form of a rectangular block and a receptacle 36 in the form of a rectangular tube projecting forward from the outer edge of the front end of the terminal accommodating portion 35.

Figure 12:
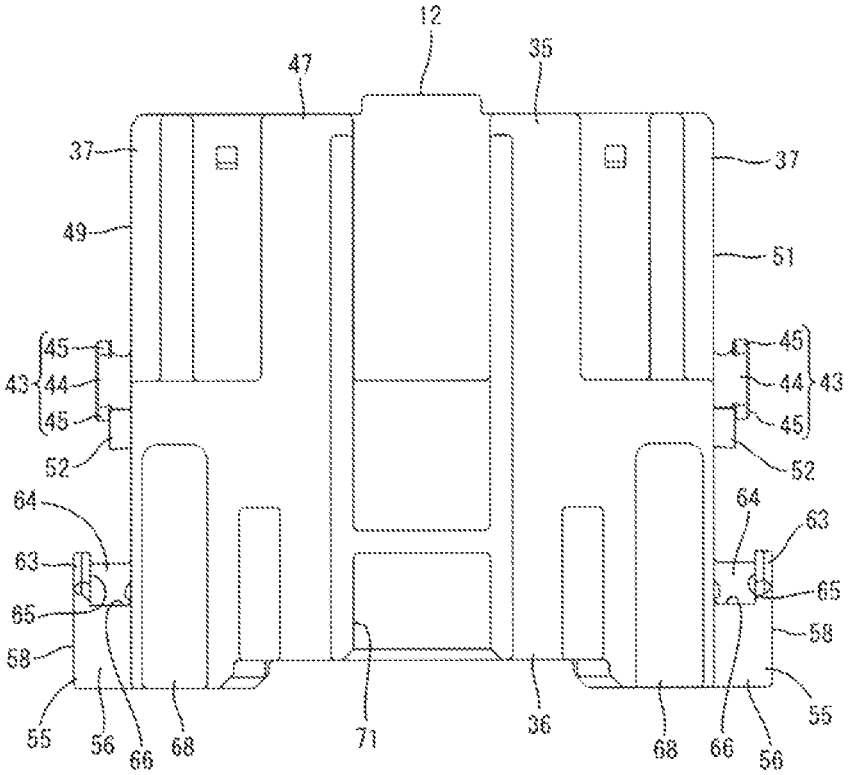
FIG. 12 is a plan view of the male housing.

As shown in FIG. 12, the terminal accommodating portion 35 includes ridges 37 extending in the front-rear direction on upper end parts of the left and right surfaces. Further, as shown in FIG. 1, male cavities 38 penetrate the terminal accommodating portion 35 in the front-rear direction. The male cavities 38 are arranged at positions corresponding to the respective female cavities 21. As shown in FIG. 8, a male terminal fitting 39 is inserted and accommodated into each male cavity 38 from behind. Each male terminal fitting 39 is made of conductive metal, includes a tab 41 projecting forward and has a rear part connected to an end part of a wire 42. Each wire 42 is pulled out rearward from the rear surface of the terminal accommodating portion 35. The tab 41 of each male terminal fitting 39 is arranged to project into the receptacle 36.

The male front retainer 14 is made of synthetic resin and, as shown in FIG. 8, mounted into the receptacle 36 of the male housing 12 from the front to cover the front surface of the terminal accommodating portion 35 (back surface of the receptacle 36). The respective male terminal fittings 39 are held in the male cavities 39 by the male front retainer 14. The tabs 41 of the male terminal fittings 39 pass through holes formed in the male front retainer 14 and the female front retainer 13 and are inserted into the corresponding female terminal fittings 22 to be connected electrically when the housings 11, 12 are connected properly.

Figure 13:
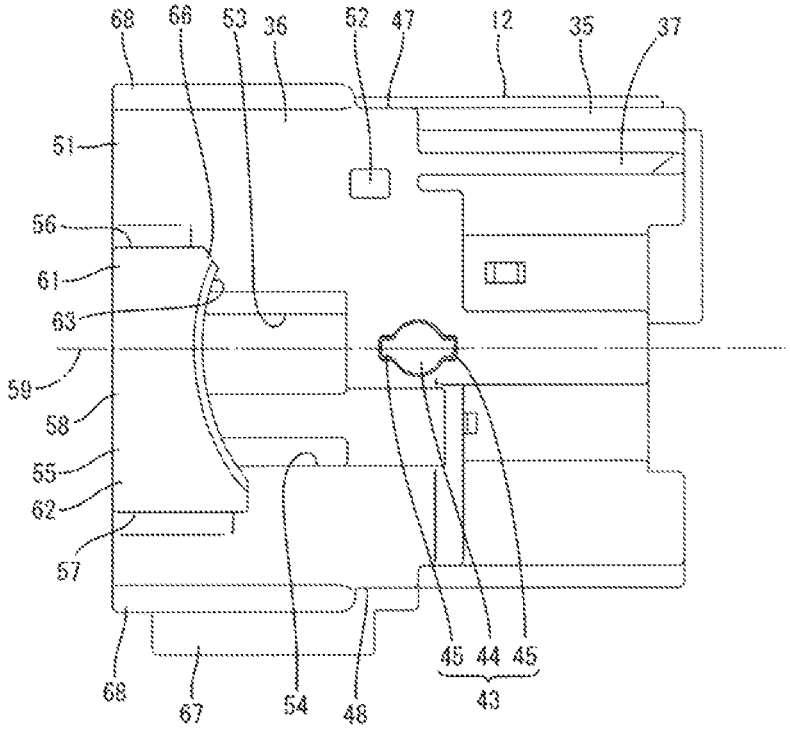
FIG. 13 is a side view of the male housing.

As shown in FIGS. 12 and 13, the male housing 12 includes shafts 43 on boundary parts of the terminal accommodating portion 35 and the receptacle 36 and on front parts of vertically central sides of left and right side surfaces. The shaft 43 has a cylindrical shaft body 44 laterally projecting from the side surface of the male housing 12 and two projecting pieces 45 protruding toward front and rear ends from a tip part of the shaft body 44 in a projecting direction. Each projecting piece 45 is a plate having a rectangular side view shape.

Figure 9:
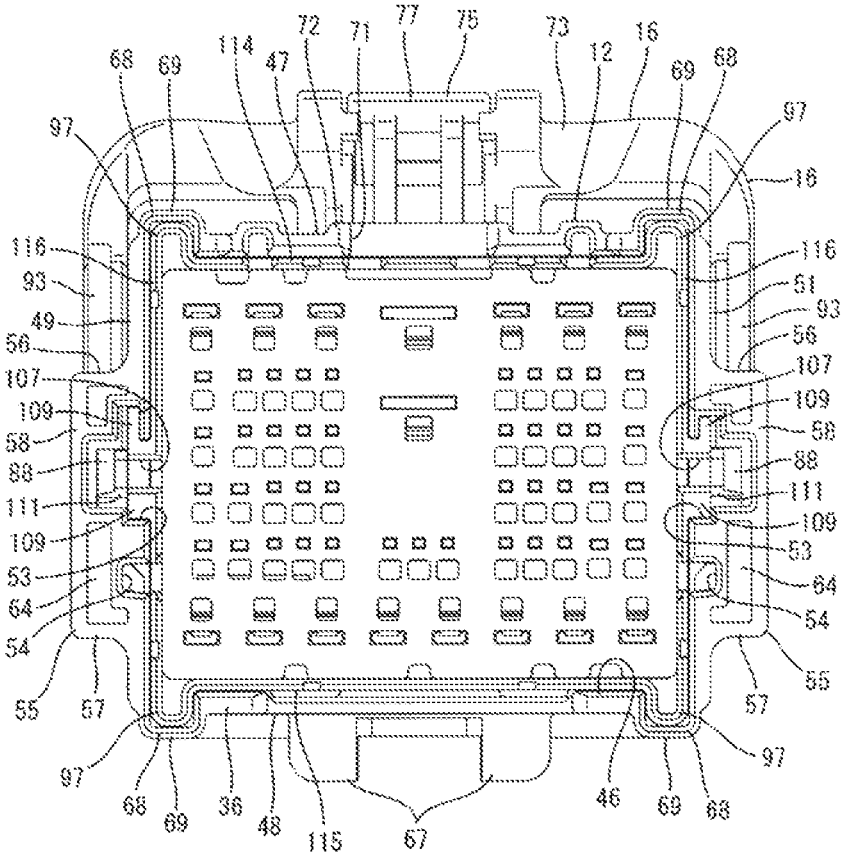
FIG. 9 is a front view showing a moving plate accommodated in a receptacle and the lever at the connection start position.
Figure 10:
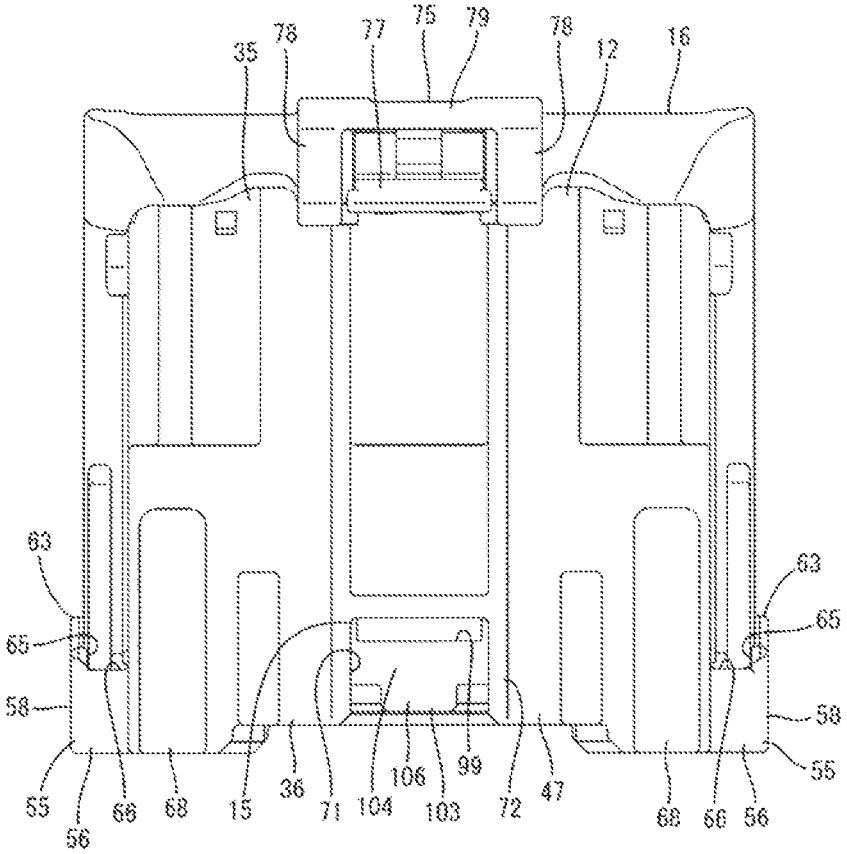
FIG. 10 is a plan view showing the moving plate accommodated in the receptacle and the lever at the connection start position.

The receptacle 36 includes a fitting space 46 into which the female housing 11 is to be fit. As shown in FIG. 9, the receptacle 36 has a first side wall 47 and a second side wall 48 vertically facing each other across the fitting space 46, and a third side wall 49 and a fourth side wall 51 laterally facing each other across the fitting space 46. The first and second side walls 47, 48 are arranged along the lateral direction, and the third and fourth side walls 49, 51 are arranged along the vertical direction. The first side wall 47 is on an upper side, and the second side wall 48 is on a lower side. The third and fourth side walls 49, 51 are line-symmetrically shaped with respect to a lateral center of the receptacle 36.

As shown in FIGS. 12 and 13, each of the third and fourth side walls 49, 51 includes a claw-like stopper protrusion 52 on a rear part of an outer surface on the side of the first side wall 47. Further, each of the third and fourth side walls 49, 51 includes an introducing groove 53 extending in the front-rear direction and open in a front end in a vertically central part, as shown in FIG. 13, and an insertion groove 54 extending in the front-rear direction and open in the front end on a side below the introducing groove 53. The introducing groove 53 is located in front of the shaft 43 and has a larger groove width than the insertion groove 54 in the vertical direction.

As shown in FIGS. 9 and 13, each of the third and four side walls 49, 51 includes a wall portion 55 disposed across the introducing groove 53 and the insertion groove 54 on a front part. The wall portion 55 includes a first leg 56 and a second leg 57 rising from an outer wall surface (hereinafter, referred to as a side surface) of the third or fourth side walls 49, 51 and respectively located on upper and lower sides, and a wall body 58 in the form of a flat plate disposed between rising ends of the first and second legs 56, 57 and covering the side surface. The first leg 56 is on the upper side and the second leg 57 is on the lower side. The first and second legs 56, 57 extend in the front-rear direction.

As shown in FIG. 13, a length of the first leg 56 in the front-rear direction is shorter than that of the second leg 57 in the front-rear direction. If an axis extending in the front-rear direction through the shaft 43 in a vertical center of the third or fourth side wall 49, 51 is assumed as a virtual axis 59, a separation distance from the virtual axis 59 to the first leg 56 in the vertical direction is shorter than a separation distance from the virtual axis 59 to the second leg 57 in the vertical direction (or in a direction perpendicular to the virtual axis 59). In this way, the wall portion 55 comprises a short part 61 in which a distance from the virtual axis 59 to the first leg 56 in the vertical direction (direction perpendicular to a fitting direction) is relatively short and a long part 62 in which a distance from the virtual axis 59 to the second leg 57 in the vertical direction is relatively long.

The wall body 58 includes an edge 63 arcuately continuous from the first leg 56 to the second leg 57 in a side view. The wall body 58 is narrowest in the front-rear direction in a part intersecting the virtual axis 59, and the edge 63 is concave forward. As shown in FIG. 12, the wall portion 55 includes an arcuate surface 64 arcuately curved to close the rear surface at a position retracted forward from the edge 63 except at a position corresponding to the introducing groove 53.

As shown in FIG. 12, a space defined by the wall body 58, the arcuate surface 64 and the side surface serves as an entrance space 65 for allowing the entrance of a later-described wall engaging portion 93 of the lever 16. The entrance space 65 is open as an entrance opening 66 in a rear end part of the first leg 56 of the short part 61.

As shown in FIG. 9, the second side wall 48 includes a mounting portion 67 in a laterally central part. The mounting portion 67 is mounted on an unillustrated vehicle with rails on both left and right sides embracing a bracket provided on the vehicle.

As shown in FIG. 9, each of the first side wall 47 and the second side wall 48 includes prying prevention receiving portions 68 on left and right end parts. Each prying prevention receiving portion 68 bulges out (up or down) in such a manner as to have a rectangular cross-section. Each prying prevention receiving portion 68 includes a bulging end surface 69 (excessive rotation restricting portion) flat in the front-rear direction and the lateral direction.

As shown in FIG. 12, the first side wall 47 includes a recess 71 in the form of a cutout having a rectangular plan view shape and open in a front end in a laterally central part. The recess 71 has a rectangular opening in a plan view. The first side wall 47 includes ribs 72 extending along left and right edges and a rear end of the recess 71 on an outer surface. The periphery of the recess 71 is surrounded and reinforced by the ribs 72. The ribs 72 extending along the left and right edges of the recess 71 are long and narrow ribs extending from the receptacle 36 to the terminal accommodating portion 35 beyond the recess 71.

Figure 17:
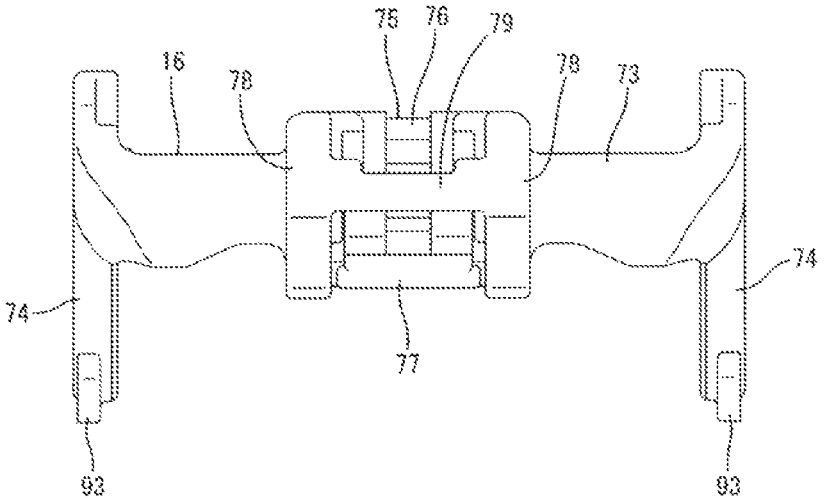
FIG. 17 is a plan view of the lever.
Figure 18:
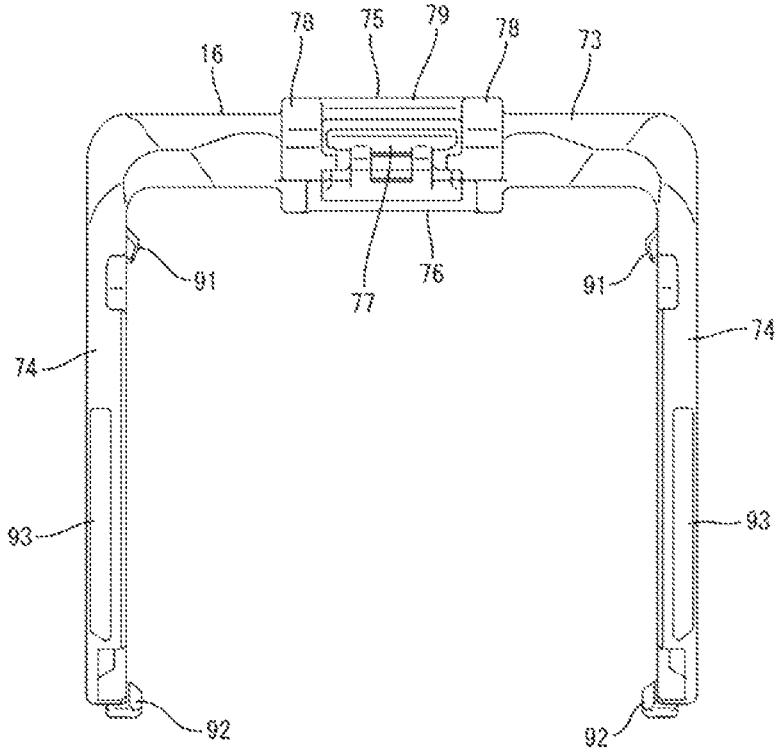
FIG. 18 is a front view of the lever.

The lever 16 is made of synthetic resin and includes, as shown in FIGS. 17 and 18, a lever operating portion 73 extending in the lateral direction and two plates 74 projecting in parallel from both left and right ends of the lever operating portion 73 while facing each other. The lever 16 is rotatable about the shafts 43 to each of an assembled position AP, a connection start position CSP and a connection end position CEP with respect to the male housing 12. At the assembled position AP shown in FIG. 2, the lever 16 is in an assembling posture in which the lever operating portion 73 is located above and behind the male housing 12. At the connection start position CSP shown in FIG. 3, the lever 16 is in a connection starting posture in which the lever operating portion 73 is slightly displaced up from the assembling posture. At the connection end position CEP shown in FIG. 4, the lever 16 is in a connection ending posture in which the lever operating portion 73 is above a front part of the male housing 12.

As shown in FIGS. 17 and 18, the lever operating portion 73 includes a lever lock receiving portion 75 in a laterally central part. The lever lock receiving portion 75 includes a base end 76 extending laterally, a lock arm 77 in the form of a U-shaped frame extending rearward from the base end 76, protecting portions 78 in the form of vertical plates connected to left and right ends of the base end 76 and extending in parallel to the lock arm 77, and a horizontal portion 79 in the form of a horizontal plate connected to the left and right protecting portions 78 and extending across the lock arm 77 outside the lock arm 77. Intermediate parts of the protecting portions 78 in the front-rear direction are coupled to parts of the lever operating portion 73 on both left and right sides.

Figure 2:
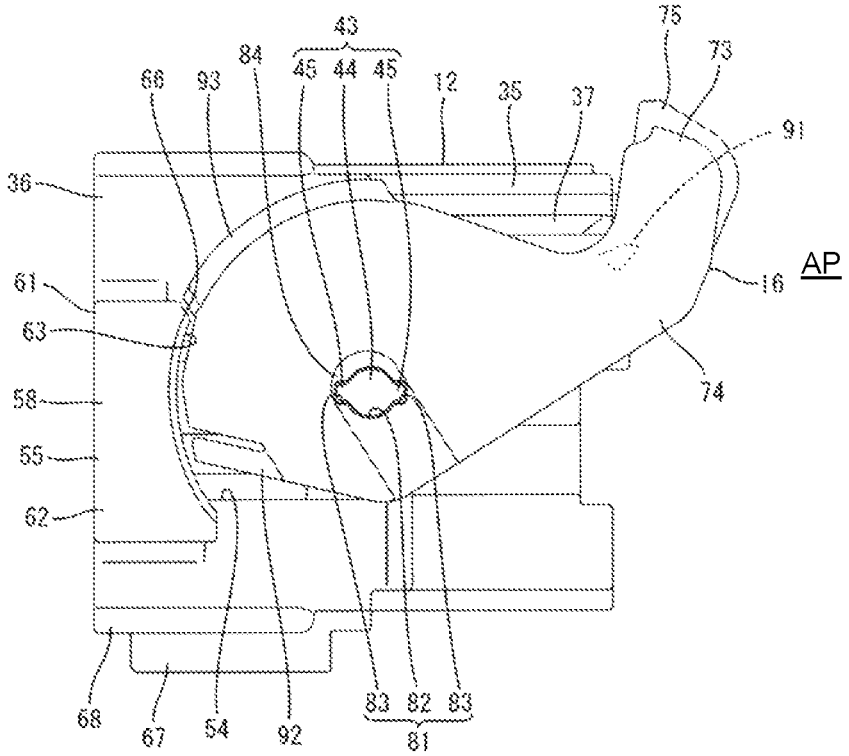
FIG. 2 is a side view showing a state where a lever is held at an assembled position with respect to a male housing.

As shown in FIG. 1, each plate 74 is a flat plate and includes a bearing 81. As shown in FIG. 2, the bearing 81 includes a shaft hole 82 penetrating through the plate 74 in a thickness direction and having a circular cross-section, and two escaping holes 83 extending in opposite radial directions (front-rear direction) from opposite radial ends (front and rear ends) of the shaft hole 82. The escaping hole 83 has a rectangular cross-section so that the projecting piece 45 is fit therein. An opening edge of the shaft hole 82 on the outer surface of each plate 74 serves as a flat sliding surface 84 slightly recessed from the surrounding. The projecting pieces 45 can slide on the sliding surface 84.

Each plate 74 includes a cam groove 85 extending in a predetermined direction around the bearing 81 on an inner surface as shown in FIG. 1. The cam groove 85 is a bottomed groove closed on an outer surface of each plate 74. A groove surface of the cam groove 85 includes a connection cam surface 86 on a side distant from the bearing 81 and a separation cam surface 87 on a side close to the bearing 81. An entrance of the cam groove 85 is open in the outer periphery of the plate 74 and includes a rib-like locking portion 88 extending in a groove width direction from the connection cam surface 86 toward the separation cam surface 87.

Each plate 74 includes a guide groove 89 arcuately extending along an outer peripheral edge on the inner surface. Further, as shown in FIG. 18, each plate 74 includes a claw-like engaging projection 91 in a part of the inner surface near the lever operating portion 73. Furthermore, each plate 74 includes a cantilevered resilient lock 92 in a part of the outer peripheral edge opposite to the locking portion 88 across the cam groove 85.

As shown in FIG. 1, the lever 16 includes wall engaging portions 93 each arcuately extending from the vicinity of the entrance of the cam groove 85 along the outer periphery of each plate 74. The wall engaging portion 93 is in the form of a rib thinner than each plate 74, and extends with a fixed width in a radial direction in a predetermined range of the outer peripheral edge of each plate 74 opposite to the bearing portion 81 across the cam groove 85.

The moving plate 15 is made of synthetic resin and includes, as shown in FIG. 1, a plate body 94 in the form of a rectangular flat plate extending along the vertical direction and the lateral direction and a peripheral wall 95 connected to the outer edge of the plate body 94 over the entire periphery and projecting forward from the outer edge. The plate body 94 includes positioning holes 96 at positions corresponding to the respective male cavities 38.

Figure 19:
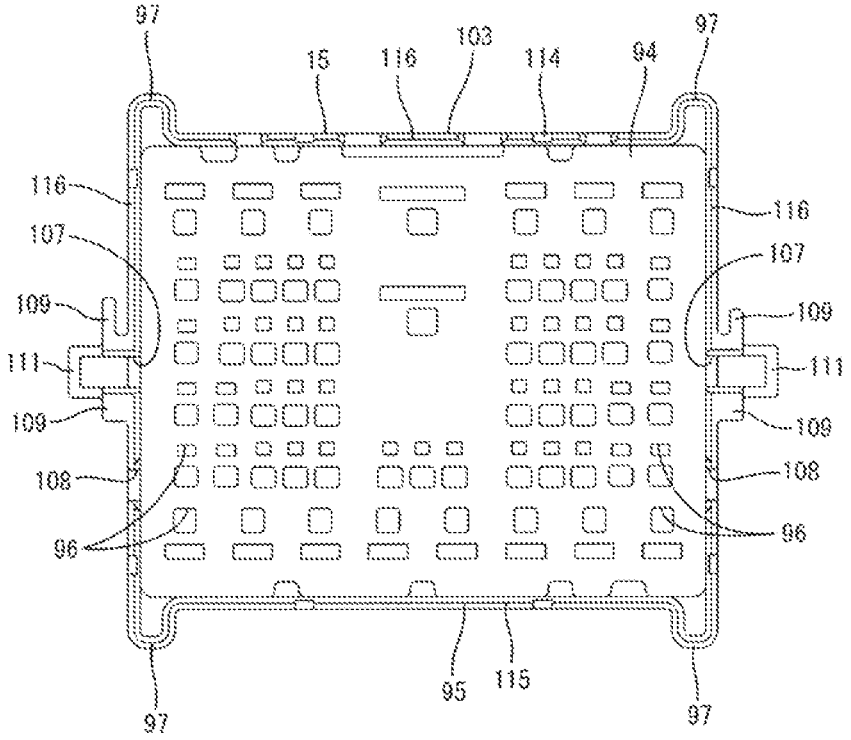
FIG. 19 is a front view of the moving plate.

As shown in FIG. 19, the peripheral wall 95 is composed of an upper panel 114 and a lower panel 115 vertically facing each other and two lateral panels 116 laterally facing each other, and is line-symmetrically shaped with respect to a lateral center. As shown in FIG. 9, the moving plate 15 is movable in the front-rear direction in the receptacle 36 with the upper panel 114 slidably facing the first side wall 47, the lower panel 115 slidably facing the second side wall 48 and the lateral panel 116 slidably facing the third and fourth side walls 49, 51.

The moving plate 15 is movable to a movement start position where the plate 94 is separated from a front surface side of the terminal accommodating portion 35 and the peripheral wall 95 is arranged along an opening side (front side) of the receptacle 36 and a movement end position where the plate 94 is in contact with or proximate to the front surface side of the terminal accommodating portion 35 via the male front retainer 14 and the peripheral wall 95 is arranged along a back side of the receptacle 36, as shown in FIG. 8.

Figure 6:
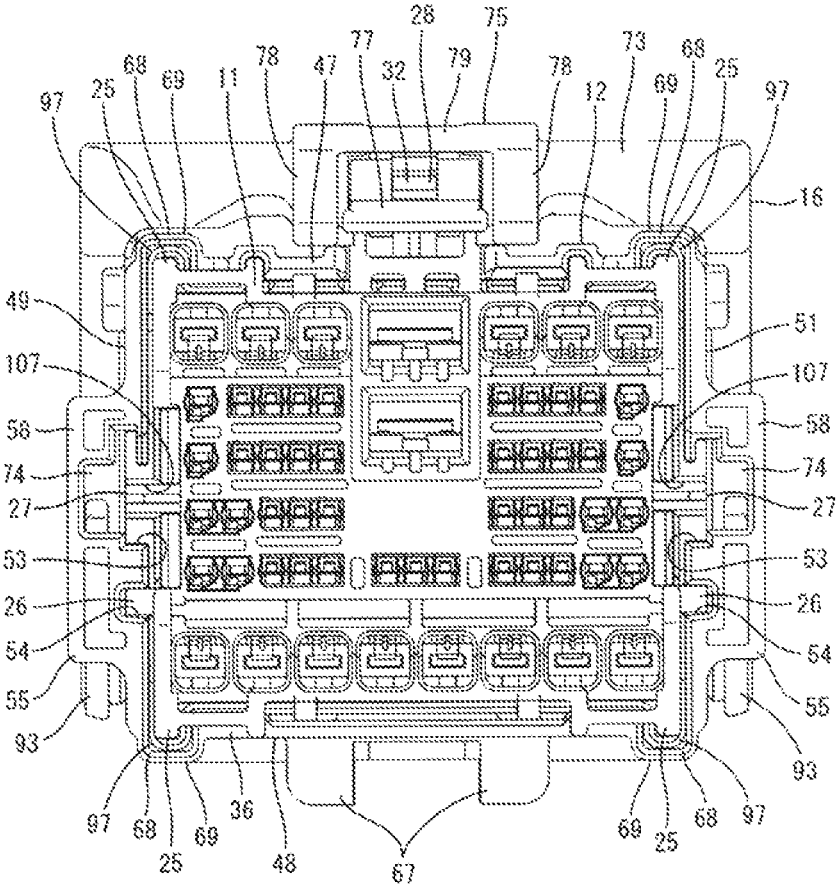
FIG. 6 is a front view of the connector assembly in a connected state when viewed from the side of the female housing.

As shown in FIG. 19, each of the upper panel 114 and the panel wall 115 of the peripheral wall 95 includes relaying prying prevention receiving portions 97 on left and right end parts. As shown in FIG. 6, each relaying prying prevention receiving portion 97 bulges out (up or down) to have a rectangular cross-section and is fittable into the corresponding prying prevention receiving portion 68.

As shown in FIG. 1, the upper panel 114 of the peripheral wall 95 includes a recess 98 slightly recessed from the surrounding in a laterally central part of an outer surface. The recess 98 is a shallow recess having a flat recessed surface part extending along the front-rear direction and the lateral direction and has a rear end open in the plate 94. Left, right and front ends of the recess 98 are defined by steps 99 rising a short distance in the vertical direction.

Figure 11:
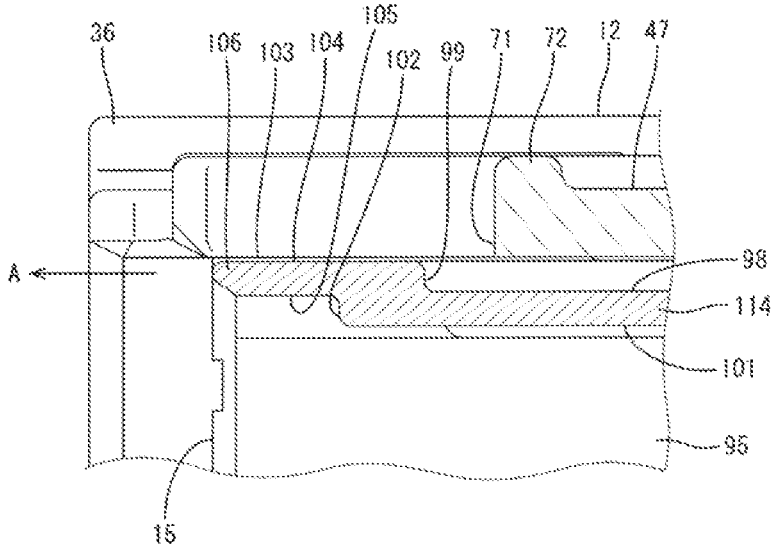
FIG. 11 is a section showing a positional relationship of an operating portion of the moving plate and a recess of the receptacle.

As shown in FIG. 11, the upper panel 114 of the peripheral wall 95 includes a projection 101 bulging in to correspond to the recess 98 in a laterally central part of an inner surface. Left, right and front ends of the projection 101 are defined by inner steps 102 corresponding to the steps 99.

As shown in FIG. 11, the upper panel 114 of the peripheral wall 95 includes an operating portion 103 in a laterally central part. The operating portion 103 includes the step 99 defining the front end of the recess 98, an outer flat surface portion 104 extending from the step 99 to the front end of the upper panel 114 while being continuous and flush with an upper surface part of the surrounding, the inner step 102 defining the front end of the projection 101 and an inner flat surface 105 extending from the inner step 102 to the front end of the upper panel 114 while being continuous and flush with a lower surface part of the surrounding. The outer and inner flat surface portions 104, 105 are arranged parallel to each other on opposite sides of the upper panel 114 of the peripheral wall 95 in a thickness direction.

As shown in FIGS. 1 and 19, the operating portion 103 includes a gripping piece 106 on the front end of the upper panel 114 of the peripheral wall 95. The front end of the upper panel 114 of the peripheral wall 95 includes recessed cut parts at both left and right sides of the gripping piece 106, and the gripping piece 106 is in the form of a rectangular plate projecting forward between the cut parts. As shown in FIG. 11, the outer surface of the gripping piece 106 constitutes the outer flat surface 104 and the inner surface of the gripping piece 106 constitutes the outer flat surface 105.

Figure 20:
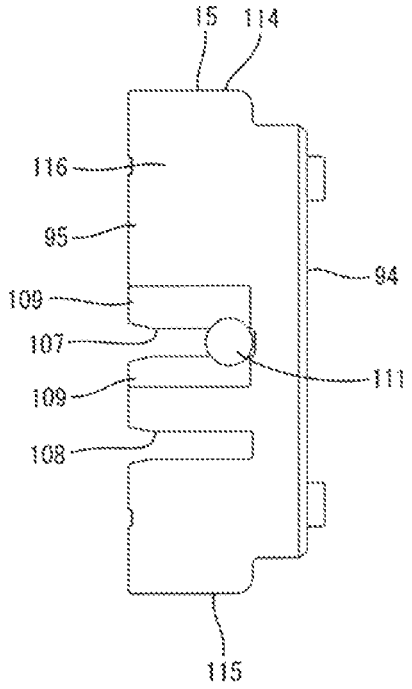
FIG. 20 is a side view of the moving plate.

As shown in FIGS. 19 and 20, each of the lateral panels 116 of the peripheral wall 95 includes an entrance groove 107 extending in the front-rear direction and open in a front end in a vertically central part and a relaying insertion groove 108 extending in the front-rear direction and open in the front end on a side below the entrance groove 107.

Each of the lateral panels 116 of the peripheral wall 95 includes rib-like guides 109 extending along upper and lower edges of the entrance groove 107 and a cam pin 111 in the form of a U-shaped frame disposed between rear parts of the upper and lower guides 109, as shown in FIG. 20. The cam pin 111 has the cam follower 27 of the female housing 11 inserted therein to form a cam part together with the cam follower 27 and is engageable with the cam groove 85.

Next, functions and effects of this embodiment are described.

In assembling the male housing 12, the lever 16 is mounted to straddle the male housing 12 from behind. At this time, the wall engaging portion 93 of the plate 74 (there are actually two plates 74, but the single (one) plate 74 is assumed to facilitate description below) is caused to face the short part 61 of the wall portion 55, and the plate 74 is slid along the third or fourth side wall 49, 51 of the male housing 12. In a sliding process, the plate 74 rides on the shaft 43 and is resiliently deformed out to expand and deform with a side coupled to the lever operating portion 73 as a support. When the lever 16 reaches the assembled position, the plate 74 resiliently returns and the shaft 43 is fit into the bearing 81 of the plate 74. If the lever 16 is in the assembling posture, the shaft body 44 enters the shaft hole 82, the projecting pieces 45 enter the escaping hole 83 to escape, and the plate 74 reliably resiliently returns.

As shown in FIG. 2, when the lever 16 reaches the assembled position AP, the outer peripheral edge of the plate 74 is arranged to face along the edge 63 of the wall portion 55, and the wall engaging portion 93 is arranged to face the entrance opening 66 of the wall portion 55 along a virtual arcuate line extending from the edge 63.

At the assembled position AP, the stopper protrusion 52 of the male housing 12 is inserted into the guide groove 89 of the plate 74 and comes into contact with the back end of the guide groove 89 to restrict downward (direction opposite to the fitting direction) rotation of the lever 1. Further, as shown in FIG. 2, the engaging projection 91 of the plate 74 is located t contact the ridge 37 of the male housing 12 at the assembled position AP to restrict forward (fitting direction) rotation of the lever 16.

Figure 5:
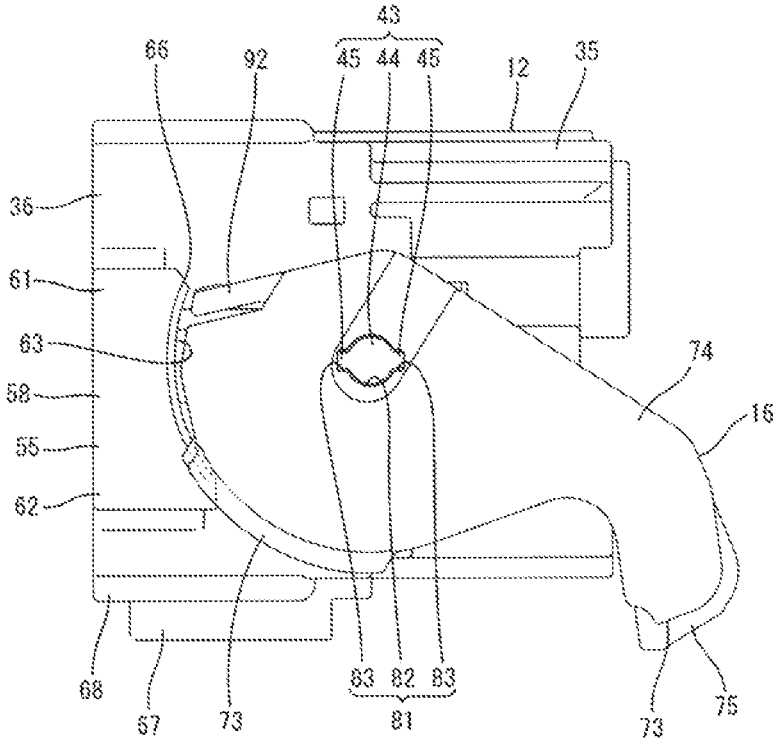
FIG. 5 is a side view showing a state where the lever is in an erroneous assembling posture with respect to a female housing and the mounting is restricted.

On the other hand, even if the lever 16 is in an improper assembling posture vertically inverted from a proper assembling posture with the lever operating portion 73 located below the male housing 12, as shown in FIG. 5, the bearing 81 of the plate 74 can reach a position where the bearing 81 is corresponding and fittable to the shaft 43. However, at this time, the wall engaging portion 93 comes into contact with the long part 62 of the wall body 58 of the wall portion 55 from outside with the plate 74 resiliently expanded outward, and an expanded state (deflected state) of the plate 74 remains and is not released. Further, the outer peripheral edge of the plate 74 butts against the edge 63 of the wall portion 55, thereby restricting any further forward movement of the lever 16. In this way, the assembling of the lever 16 is impeded and it can be detected that the lever 16 is in the improper assembling posture.

The moving plate 15 is positioned in the receptacle 36 by fitting the relay prying prevention receiving portions 97 into the prying prevention receiving portions 68 of the receptacle 36. Further, with the guides 109 fit and inserted in the introducing grooves 53 of the receptacle 36, the cam pins 111 enter the entrances of the cam grooves 85 of the plates 74 and the moving plate 15 is held at the movement start position in a movement restricted state (see FIG. 9). When the moving plate 15 is at the movement start position, tips of the tabs 41 of the male terminal fittings 39 are inserted in the positioning holes 96 of the plate body 94 to protect the male terminal fittings 39. Further, at the movement start position, the operating portion 103 of the peripheral wall 95 is located inside the recess 71 of the receptacle 36 and the gripping piece 106, the steps 99 and the recess 98 can be seen through the recess 71 (se FIG. 10).

Figure 3:
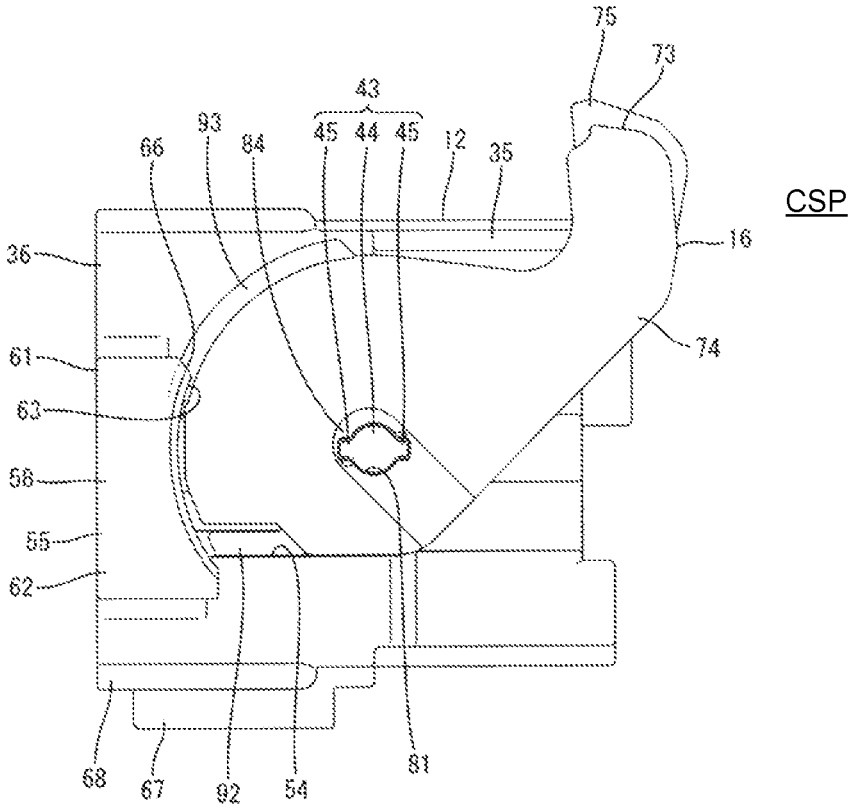
FIG. 3 is a side view showing a state where the lever is held at a connection start position with respect to the male housing.

Subsequently, the lever operating portion 73 is pushed up to apply an operation force to the movement start position to the lever 16. Then, locking between the engaging projection 91 of the plate 74 and the ridge 37 is released and the lever 16 is brought to the connection start position CSP. As shown in FIG. 3, at the connection start position CSP, the resilient lock 92 of the plate 74 is locked resiliently to the groove edge of the insertion groove 54 to restrict the rotation of the lever 16. Further, as shown in FIG. 9, the locking portion 88 partially closing the entrance of the cam groove 85 on the plate 74 is arranged outside the entrance groove 107 to face the front of the outer part of the cam pin 111. Thus, at the connection start position CSP, the cam pin 111 contacts the locking portion 88 to restrict forward detachment of the moving plate 15 from the receptacle 36. Further, as shown in FIG. 3, at the connection start position CSP, one end of the wall engaging portion 93 of the plate 74 (tip part of the lever 16 in a rotating direction) enters the entrance space 65 through the entrance opening 66 of the wall portion 55 and has the outer side covered by the wall body 58.

In the above state, the mating female housing 11 is fit lightly into the receptacle 36. Then, the cam followers 27 of the female housing 11 are inserted into the entrance grooves 107 of the moving plate 15 and arranged inside the cam pins 111, and the cam followers 27 and the cam pins 111 are united to constitute the cam parts. Further, the releasing portions 26 of the female housing 11 are inserted into the insertion grooves 54 via the relaying insertion grooves 108 to press the resilient locks 92, thereby releasing locking between the resilient locks 92 and the edges of the insertion grooves 54.

The prying preventing portions 25 of the female housing 11 are fit into the relaying prying prevention receiving portions 97. In this way, the female housing 11 is prevented from being fit improperly into the receptacle 36 in a prying connection posture inclined from a proper connection posture. Further, when the female housing 11 is fit lightly into the receptacle 36, a front part of the lever lock 28 enters the recess 71 of the receptacle 36 and a part of the operating portion 103 including the gripping piece 106 escapes into the escaping portion 34 of the lever lock 28.

From the above state, the lever 16 is rotated toward the connection end position CED while the lever operating portion 73 is gripped. In the process of rotating the lever 16 toward the connection end position CED, the united cam parts slide on the connection cam surfaces 86 of the cam grooves 85, a cam mechanism works between the female housing 11 and the lever 16, and the female housing 11 is pulled gradually into the receptacle 36. Further, the moving plate 15 moves toward the movement end position and the peripheral wall 95 slides on the inner surface of the receptacle 36. The tabs 41 of the male terminal fittings 39 also project farther from the positioning holes 96 of the plate body 94 and are inserted into the corresponding female terminal fittings 22. Furthermore, the lever lock 28 is displaced toward a back of the recess 71.

In the rotating process of the lever 16, each projecting piece 45 of the shaft 43 slides on the sliding surface 84. Thus, even if the plate 74 is going to be expanded with the side thereof near the lever operating portion 73 as a support by receiving connection resistance of the connector, the plate 74 contacts each projecting piece 45 and outward expanding deformation is restricted on the supporting point.

Figure 4:
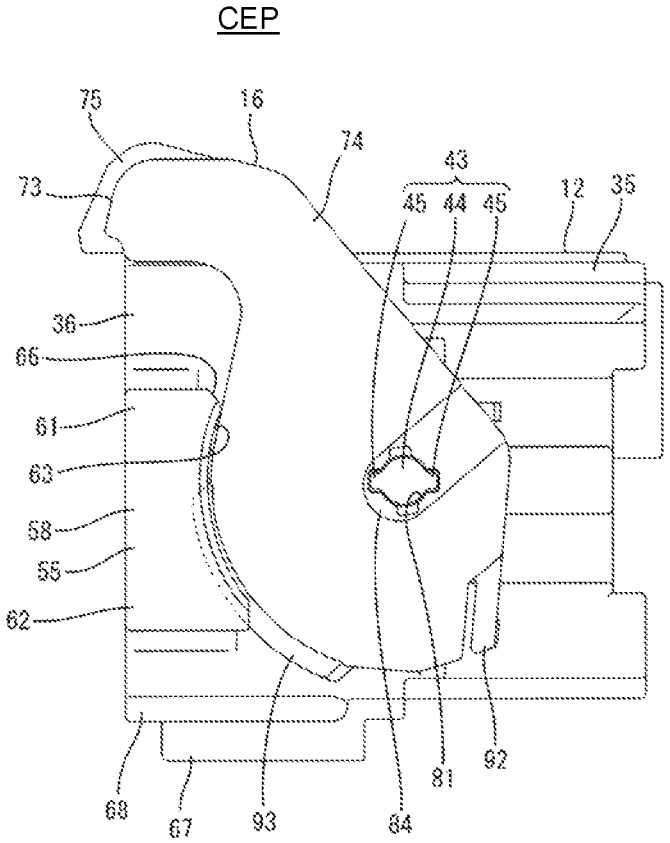
FIG. 4 is a side view showing a state where the lever is held at a connection end position with respect to the male housing.

In the rotating process of the lever 16, the wall engaging portion 93 gradually is inserted farther into the entrance space 65 of the wall portion 55 and a state where the wall engaging portion 93 is covered by and can contact the wall body 58 is maintained constantly, as shown in FIGS. 3 to 4. Thus, outward expanding deformation of the plate 74 is restricted on an outer peripheral side by contact of the wall engaging portion 93 with the wall body 58.

When the lever operating portion 73 is turned to the front of the female housing 11 and the lever 16 reaches the connection end position CEP, as shown in FIG. 4, the lever lock receiving portion 75 is put over the lever lock 28 from above and the lock arm 77 is locked by the lever lock projection 32, as shown in FIG. 8. In this way, the lever 16 is held on the female housing 11 in a rotation restricted state and the female housing 11 is held in the receptacle 36 of the male housing 12. Further, as shown in FIG. 6, parts of the lever operating portion 73 on left and right sides across the lever lock receiving portion 75 contact the bulging end surfaces 69 of the prying prevention receiving portions 68 on both left and right of the upper side (side of the first side wall 47) at the connection end position CEP to restrict further rotation of the lever 16.

Figure 7:
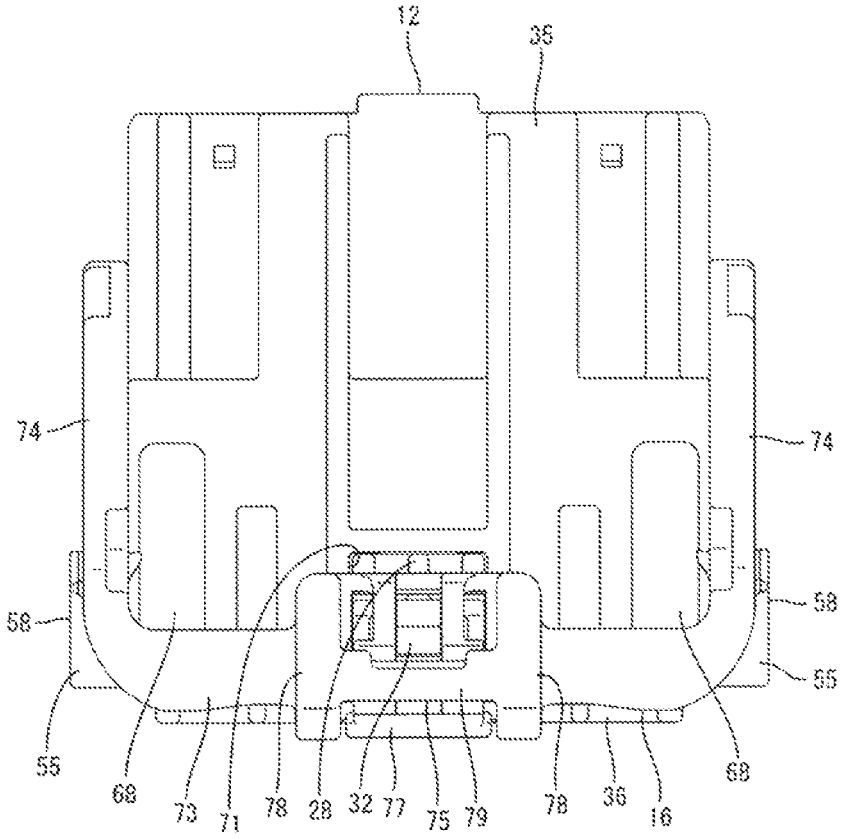
FIG. 7 is a plan view of the connector assembly in the connected state.

As shown in FIG. 7, when the lever 16 is at the connection end position CEP, a locked state of the lever lock 28 and the lever lock receiving portion 75 can be confirmed visually from above. As shown in FIG. 8, the lever lock portion 28 is inserted entirely in the recess 71 and is near or in contact with the back of the recess 71. The gripping piece 106 of the operating portion 103 is inserted into the escaping portion 34 of the lever lock 28. Thus, the operating portion 103 and the lever lock 28 are in such a positional relationship as to partially overlap in the front-rear direction.

When the connector is connected properly in the above way, the plate body 94 of the moving plate 15 is sandwiched between the front surface of the terminal accommodating portion 35 (back of the receptacle 36) and the female housing 11 via the male front retainer 14, and the tabs 41 of the male terminal fittings 39 are inserted properly into the female terminal fittings 22 to be connected, as shown in FIG. 8.

When the lever 16 is at the connection end position CEP and the connector is held in the connected state, as shown in FIG. 4, a front of the wall engaging portion 93 in the rotating direction of the lever 16 projects a predetermined length from an exit side of the wall portion 55 (opening side opposite to the entrance opening 66). Thus, the rotated state of the lever 16 can be confirmed and, eventually, whether or not the connector has been connected properly can be detected by seeing the projecting state of the wall engaging portion 93 from the exit side of the wall portion 55 from a lateral side. On the other hand, a rear of the wall engaging portion 93 in the rotating direction of the lever 16 is inserted into the entrance space 65 of the wall portion 55 and can contact the wall body 58 to restrict outward expanding deformation of the plate 74.

On the other hand, to separate the female housing 11 from the receptacle 36 of the male housing 12, the lock arm 77 is first lifted up to release locking between the lever lock receiving portion 75 and the lever lock 28. From that state, the lever 16 is rotated rearward toward the connection start position CSP while the lever operating portion 73 is gripped. In the process of rotating the lever 16 toward the connection start position CSP, the united cam parts slide on the separation cam surfaces 87 of the cam grooves 85, a cam mechanism works between the female housing 11 and the lever 16, and the female housing 11 is separated from the front surface side of the terminal accommodating portion 35 (back of the receptacle 36). Then, the lever lock portion 28 is separated from the back of the recess 71. Furthermore, the cam pins 111 of the cam parts slide on the separation cam surfaces 87 of the cam grooves 85. Thus, a cam mechanism works between the moving plate 15 and the lever 16, and the moving plate 15 also is separated from the front of the terminal accommodating portion 35 and moved toward the movement start position.

When the lever 16 reaches the connection start position CSP, the resilient lock 92 of the plate 74 is locked to the edge of the insertion groove 54 to stop the rotation of the lever 16. Also when the lever 16 is at the connection start position CSP, the state where the wall engaging portion 93 is in the entrance space 65 of the wall portion 55 and can contact the wall body 58 is maintained.

When the lever 16 reaches the connection start position CSP, a rear part of the lever lock 28 projects from the opening end (front end) of the receptacle 36. In that state, the female housing 11 is pulled out from the receptacle 36 to separate the female housing 11 from the male housing 12 while the lever lock portion 28 is gripped.

Subsequently, the lever 16 is rotated to the assembled position AP and the moving plate 15 returns to the movement start position. Thus, the cam pins 111 at the entrances of the cam grooves 85 are separated from the locking portions 88, and the moving plate 15 can be separated from the receptacle 36. In short, the moving plate 15 is unlocked from the lever 16 and the receptacle 36.

In the above state, worker's fingers are inserted into the recess 71, e.g. a thumb is pressed against the outer flat surface portion 104 and an index finger is pressed against the inner flat surface portion 105, whereby the operating portion 103 is sandwiched in the thickness direction by the worker's fingers. In that state, the operating portion 103 is pulled in a direction of an arrow A of FIG. 11 to be separated from the recess 71 and, hence, the moving plate 15 is separated from the receptacle 36. Further, the operating portion 103 may be separated from the recess 71, for example, with the finger tip of the index finger inserted in the recess 98 and hooked to the step 99 of the operating portion 103. In this way, the moving plate 15 is easily removed from the male housing 12.

As described above, the following effects can be achieved according to this embodiment.

The connector includes the male housing 12 having the receptacle 36 and the moving plate 15 to be movably accommodated into the receptacle 36, and the moving plate 15 includes the operating portion 103 for removal exposed from the recess 71 of the receptacle 36 on the peripheral wall 95. According to this configuration, the moving plate 15 can be easily removed from the receptacle 36, such as by a worker gripping the operating portion 103 even without inserting the fingers into the receptacle 36.

The receptacle 36 includes the recess 71 in the form of a cutout for allowing the entrance of the operating portion 103. According to this configuration, with the moving plate 15 accommodated inside the receptacle 36, the operating portion 103 does not project significantly rearward from the receptacle 36 and the length of the connector in the front-rear direction is small. As a result, plural connectors can be transported without being bulky.

The lever 16 for connecting the housings 11, 12 is assembled rotatably with the male housing 12, the female housing 11 includes the lever lock 28 for locking the lever 16, and the lever lock 28 enters the recess 71. Accordingly, the recess 71 also serves as an entrance area for the lever lock 28 and space efficiency is excellent.

The lever lock 28 includes the escaping portion 34 for allowing the operating portion 103 to escape. According to this configuration, the lever operating portion 73 can escape into the escaping portion 34 and interference with the lever lock 28 is avoided. Further, the lever lock 28 and the operating portion 103 overlap in the front-rear direction by as much as the escaping portion 34 to shorten a length of the connector in the front-rear direction.

The receptacle 36 includes the ribs 72 extending along the periphery of the recess 71. According to this configuration, even if the recess 71 in the form of a cutout is provided in the receptacle 36, the rigidity of the receptacle 36 can be ensured by the ribs 72.

The operating portion 103 of the moving plate 15 includes the outer flat surface 104 exposed on the outer surface of the peripheral wall 95 and the inner flat surface 105 exposed on the inner surface of the peripheral wall 95, and the outer and inner flat surfaces 104, 105 are arranged across the peripheral wall 95. Accordingly, the worker can remove the moving plate 15, for example, while gripping the outer and inner flat surfaces 104, 105 by fingers.

The peripheral wall 95 includes the recess 98 recessed from the surrounding on the outer surface, the recess 98 includes the step 99 extending in the width direction intersecting the front-rear direction (moving direction of the moving plate 15), and the step 99 is included in the operating portion 103. According to this configuration, the worker can remove the moving plate 15, for example, while hooking the finger on the step 99.

The outer flat surface 104 is connected to the step 99 and continuous with the outer surface around the peripheral wall 95, and the operating portion 103 includes the step 99 and the outer flat surface 104. According to this configuration, the worker can remove the moving plate 15, for example, while pressing the finger against the step 99 and the outer flat surface 104.

The receptacle 36 includes, on the inner surface, the projection 101 located on the side opposite to the recess 98 and shaped to correspond to the recess 98. The recess 98 and the projection 101 correspond to each other in this way so that the thickness of the receptacle 36 does not increase or decrease and the sink and deflection of the receptacle 36 can be suppressed.

The lever 16 is mounted on the male housing 12, can be in the assembling posture in which the lever 16 is to be assembled with the housing and in the connection starting posture which is attained by being rotated from the assembling posture and in which the connection of the housings 11, 12 can be started, and includes the two plates 74. Each of the plates 74 includes the cam groove 85, the moving plate 15 includes the cam pins 111 provided on the peripheral wall 95 and configured to move the moving plate 15 by being engaged with the cam grooves 85. Each of the plates 74 includes, on the surface of the cam groove 85, the locking portion 88 for retaining the moving plate 15 by locking the cam pin 111 in the connection starting posture, and the cam pin 111 is separated from the locking portion 88 and arranged at the entrance of the cam groove 85 to be able to come out in the assembling posture of the lever 16. According to this configuration, when the lever 16 is in the assembling posture, the moving plate 15 is in a free state without being locked to the male housing 12 and the lever 16. Therefore, the moving plate 15 can be removed easily in that state while the operating portion 103 is gripped.

The connector includes the female housing 11 having the lever lock 28 projecting therefrom and the male housing 12 having the tubular receptacle 36 into which the female housing 11 is fit. The receptacle 36 includes the recess 71 in the form of a cutout into which the lever lock 28 enters, and the lever 16 is assembled with the male housing 12 and includes the lever lock receiving portion 75 to be locked by the lever lock 28 inserted into the recess 71. By inserting the lever lock 28 into the recess 71 in this way, the length of the connector in the front-rear direction can be shortened.

The female housing 11 includes the connection surface 17 on the front surface side, the wire pull-out surface 18 on the rear surface side and the side surface 19 facing in the directions intersecting each of the wire pull-out surface 18 and the connection surface 17, and the lever lock 28 is provided on the side surface 19. According to this configuration, a degree of freedom in molding the lever lock 28 can be enhanced.

No part of the lever lock 28 projects rearward from the wire pull-out surface 18. According to this configuration, the interference of the lever lock 28 with the respective wires 23 pulled out from the wire pull-out surface 18 can be avoided and a degree of freedom in routing the wires 23 can be enhanced.

A mutually locking structure of the lever lock 28 and the lever lock receiving portion 75 can be confirmed visually from above the female housing 11. According to this configuration, the locked state of the lever lock 28 and the lever lock receiving portion 75 can be confirmed easily, and a situation where the lever 16 is left unlocked to the female housing 11 can be avoided.

The entire lever lock 28 enters the recess 71 of the receptacle 36. According to this configuration, the length of the connector in the front-rear direction can be made even shorter.

The lever lock 28 projects higher than the outer surface of the receptacle 36 located around while being located in the recess 71. Accordingly, the female housing 11 can be pulled out from the receptacle 36 while the lever lock 28 is gripped, for example, in separating the connector.

The receptacle 36 includes the first side wall 47 and the second side wall 48 facing each other across the fitting space 46 into which the female housing 11 is to be fit, the first side wall 47 includes the recess 71 and the second side wall 48 includes the mounting portion 67 for mounting on a vehicle body. According to this configuration, when the receptacle 36 is mounted on the vehicle body via the mounting portion 67, the recess 71 is located on the side in front of the worker. Thus, for example, a state where the lever lock 28 is entering the recess 71 can be confirmed visually and the female housing 11 can be prevented from being fit into the receptacle 36 in a wrong posture.

The receptacle 36 includes the prying prevention receiving portions 68 that can come into contact with the lever 16 with the lever lock 28 and the lever lock receiving portion 75 locked to each other. According to this configuration, the prying prevention receiving portions 68 function as excessive rotation restricting portions for the lever 16 and excessive rotation of the lever 16 is impeded by the prying prevention receiving portions 68.

The prying prevention receiving portions 68 are provided on both sides across the recess 71 on the receptacle 36. According to this configuration, excessive rotation of the lever 16 can be impeded more reliably.

The prying prevention receiving portions 68 prevent prying connection of the housings 11, 12 by receiving the prying preventing portions 25 and also restricting excessive rotation of the lever 16.

The flat bulging end surfaces 69 of the prying prevention receiving portions 68 serve as the excessive rotation restricting portions. Thus, the structure of the receptacle 36 is not complicated.

Further, the female housing 11 includes the two cam followers 27, the male housing 12 includes the two side surfaces constituting the outer wall surfaces of the third and fourth side walls 49, 51 of the receptacle 36, the shafts 43 respectively project on the side surfaces and the wall portions 55 arranged outside the pair of side surfaces. Additionally, the lever 16 includes the operating portion 103 for a rotating operation, the two plates 74 projecting from the operating portion 103 while facing each other and provided with the cam grooves 85 to be engaged respectively with the cam followers 27 by being rotated, the bearings 81 respectively provided on the plates 74, and the wall engaging portions 93 respectively provided on the plates 74 located to enter the entrance spaces 65 inside the walls 55 in the rotating direction by the plates 74 facing the corresponding side surfaces and the shafts 43 being fit into the bearing portions 81 and, on the other hand, configured to contact with the walls 55 from outside with the plates 74 deflected by the plates 74 respectively erroneously facing the side surfaces not corresponding thereto.

According to this configuration, the plates 74 are prevented from expanding, for example, by the wall engaging portions 93 entering the entrance spaces 65 and becoming capable of coming into contact with the wall portions 55 from inside. Further, since the wall engaging portions 93 contact the wall portions 55 from outside to deflect the plates 74 when the lever 16 is in an erroneous assembling posture, the shafts 43 cannot be fit into the bearings 81, thereby preventing the lever 16 being mounted on the male housing 12 while being in the erroneous assembling posture. As just described, the wall portions 55 and the wall engaging portions 93 have both a function of restricting erroneous assembling of the housings 11, 12 and a function of restricting the expansion of the plates 74 so that the structure can be simplified.

The lever 16 can be in the assembling posture in which the lever 16 is to be assembled with the male housing 12, in the connection start posture attained by rotation from the assembling posture and in which the cam followers 27 can enter the cam grooves 85, and in the connection ending posture in which the cam followers 27 are at the backs of the cam grooves 85, and the wall engaging portions 93 face the openings 66 in the wall portions 55 in the assembling posture. Accordingly, when the lever 16 is in the assembling posture, the wall engaging portions 93 do not interfere with the wall portions 55 and assembly work is excellent. Further, when the lever 16 is rotated to the connection starting posture, the wall engaging portions 93 quickly enter the entrance spaces 65 inside the wall portions 55 through the entrance openings 66.

The wall engaging portions 93 enter the entrance spaces 65 inside the wall portions 55 in an entire displacement range of the lever 16 from the connection starting posture to the connection ending posture. Thus, expansion of the plates 74 is prevented by the wall portions 55 in the entire process of connecting the housings 11, 12 and reliability in preventing expansion is excellent.

The wall portion 55 is asymmetrical with respect to the virtual axis 59 along the front-rear direction (fitting direction of the housings 11, 12) passing through the shaft 43. Accordingly, it can be easily realized by the asymmetric shape of the walls 55 that the wall engaging portions 93 are located to enter the entrance spaces 65 inside the walls 55 when the lever 16 is in the proper assembling posture and the wall engaging portions 93 contact the wall portions 55 from outside when the lever 16 is in the erroneous assembling posture.

The wall portion 55 includes the short part 61 extending a short distance up (one side perpendicular to the fitting direction of the housings 11, 12) from the virtual axis 59 and the long part 62 extending a longer distance than the short part 61 down (other side perpendicular to the fitting direction of the housings 11, 12) from the virtual axis 59, and the entrance opening 66 for the wall engaging portion 93 is provided inside the short part 61. Accordingly, erroneous assembling of the lever 16 can be prevented by locating the wall engaging portions 93 on the side of the short parts 61 when the lever 16 is assembled. Further, by forming the wall portion 55 relatively long from the long part 62 to the short part 61, the strength of the receptacle 36 can be improved.

The shaft 43 includes, on each of the side surfaces of the receptacle 36, the shaft body 44 projecting from the side surface and the projecting pieces 45 projecting toward the opposite radial sides from the tip of the shaft body 44. The bearing 81 includes, in each of the pair of plates 74, the shaft hole 82 through which the shaft body 44 penetrates and the two escaping holes 83 communicating with the shaft hole 82, extending toward the opposite radial sides and allowing the passage of the projecting pieces 45. Each of the plates 74 includes the sliding surface 84 around the opening of the shaft hole 82, the projecting pieces 45 being slidable on the sliding surface 84 in the rotating direction. The projecting pieces 45 project toward the opposite radial sides and the escaping holes 83 extend toward the opposite radial sides. Thus, a large angle of rotation of the lever 16 can be ensured. Erroneous assembling of the lever 16 is prevented by the walls 55 and the wall engaging portions 93. Thus, the shaft 43 can be symmetrical on each of the side surfaces.

The projecting pieces 45 and the escaping holes 83 extend along the front-rear direction (fitting direction of the housings 11, 12). Accordingly, the projecting pieces 45 and the escaping holes 83 can be molded with the male cavities 38, utilizing a mold that is pulled out in the front-rear direction.

The wall engaging portion 93 is a rib extending in the rotating direction on the outer periphery of each of the plates 74. According to this configuration, the wall engaging portion 93 easily engages the wall 55.

A length of the wall engaging portion 93 in the rotating direction is at least equal to a length of the wall portion 55 in the rotating direction. Thus, the wall engaging portion 93 is engaged more easily with the wall portion 55.

The lever 16 can be in the connection starting posture in which the cam followers 27 can enter the entrances of the cam grooves 85 and in the connection ending posture which is attained by being rotated from the connection starting posture and in which the cam followers 27 are located on the back sides of the cam grooves 85, the wall engaging portions 93 are in the form of ribs extending in the rotating direction on the outer peripheries of the pair of plates 74, and the wall engaging portions 93 are partially exposed from the wall portions 55 and can be visually confirmed in the connection ending posture. According to this configuration, it can be easily detected that the lever 16 is in the connection ending posture by visually confirming the state where the wall engaging portions 93 are partially exposed from the wall portions 55.

The wall engaging portion 93 is configured to enter the entrance space 65 inside the wall portion 55 and slide on the inner surface of the wall portion 55. According to this configuration, the two plate portions 74 can be more reliably prevented from expanding. Further, an opening width of the entrance space 65 can be made smaller and the enlargement of the connector can be avoided.

Note that, the female front retainer 13 and the male front retainer 14 may be omitted from the connector. In this case, the female terminal fittings 22 and the male terminal fittings 39 are retained by the locking action of locking lance parts of the female housing 11 and the male housing 12. Further, the connector may include a female front mask and a male front mask having no retainer function instead of the female front retainer 13 and the male front retainer 14.

REFERENCE SIGNS

11 . . . female housing (first housing; mating housing)
12 . . . male housing (second housing; housing)
15 . . . moving plate
16 . . . lever
17 . . . connection surface
18 . . . wire pull-out surface
19 . . . side surface
22 . . . female terminal fitting (first terminal fitting)
25 . . . prying preventing portion
27 . . . cam follower
28 . . . lever lock portion
34 . . . escaping portion
36 . . . receptacle
39 . . . male terminal fitting (second terminal fitting; terminal fitting)
41 . . . tab
43 . . . shaft
44 . . . shaft body
45 . . . projecting piece
47 . . . first side wall
48 . . . second side wall
49 . . . third side wall
55 . . . wall portion
59 . . . virtual axis
61 . . . short part
62 . . . long part
66 . . . entrance opening
67 . . . mounting portion
68 . . . prying prevention receiving portion
69 . . . bulging end surface (excessive rotation restricting portion)
71 . . . recess
72 . . . rib
73 . . . lever operating portion
74 . . . plate
75 . . . lever lock receiving portion
81 . . . bearing
82 . . . shaft hole
83 . . . escaping hole
84 . . . sliding surface
85 . . . cam groove
88 . . . locking portion
93 . . . wall engaging portion
94 . . . plate body
95 . . . peripheral wall
96 . . . positioning hole
98 . . . recess
98 . . . step
101 . . . projection
103 . . . operating portion
104 . . . outer flat surface portion
105 . . . inner flat surface portion
111 . . . cam pin

What is claimed is:

1. A connector, comprising:

a housing including a receptacle configured to receive a mating housing;

terminal fittings each including a tab projecting into the receptacle; and a moving plate movably accommodated into the receptacle, the moving plate including a plate body provided with positioning holes enabling insertion of the terminal fittings and at least one peripheral wall connected to a periphery of the plate body and slidable on an inner surface of the receptacle, an operating portion for removal being provided on the peripheral wall, the operating portion including an outer flat surface and an inner flat surface at least partially exposed on outer and inner surfaces of the peripheral wall respectively, and the operating portion being exposed from the receptacle.

2. The connector of claim 1, wherein the receptacle includes at least one rib extending substantially adjacent to and along a periphery of the recess.

3. The connector of claim 1, further comprising:

a lever rotatably assembled with the housing and configured to connect the housing with the mating housing;

the lever is configured to assume an assembling posture in which the lever is to be assembled with the housing and a connection starting posture attained by being rotated from the assembling posture and in which connection of the housing with the mating housing;

the lever includes plates, each of the plates includes a cam groove, and cam pins are provided on the peripheral wall of the moving plate and are configured to move the moving plate by being engaged with the cam grooves;

the plates include a locking portion provided on a surface of the cam groove and configured to retain the moving plate by locking the cam pin in the connection starting posture of the lever; and the cam pin is separated from the locking portion and arranged at an entrance of the cam groove to be able to come out in the assembling posture of the lever.

4. The connector assembly of claim 1, further comprising an escaping portion provided in a base part of the lever lock and configured to allow the operating portion to escape.

5. The connector of claim 1, wherein a recess recessed from a surrounding is provided in the outer surface of the peripheral wall, the recess including at least one step extending in a direction intersecting a moving direction of the moving plate, the step being included in the operating portion.

6. The connector of claim 5, wherein the outer flat surface of the operating portion is connected to the step and continuous with the surrounding, and the operating portion includes the step and the outer flat surface portion.

7. The connector of claim 5, wherein a projection is provided at a position substantially opposite to the recess on the inner surface of the receptacle and is shaped to correspond to the recess.

8. The connector of claim 1, wherein the receptacle includes a recess in the form of a cutout into which the operating portion is inserted.

9. A connector assembly comprising:

the connector of claim 8 having the housing;

a mating connector having the mating housing connectable to the housing;

a lever configured to connect the housings being rotatably assembled with the housing;

the mating housing includes a lever lock configured to lock the lever; and the lever lock enters the recess.

* * * * *